US007677235B2

(12) United States Patent
Zimmerman

(10) Patent No.: US 7,677,235 B2
(45) Date of Patent: Mar. 16, 2010

(54) TOY GUN

(75) Inventor: Jeffrey C. Zimmerman, King of Prussia, PA (US)

(73) Assignee: Buzz Bee Toys (H.K.) Co., Limited, Kowloon, Hong Kong (CN)

( * ) Notice: Subject to any disclaimer, the term of this patent is extended or adjusted under 35 U.S.C. 154(b) by 384 days.

(21) Appl. No.: 11/504,195

(22) Filed: Aug. 15, 2006

(65) Prior Publication Data

US 2007/0006862 A1 Jan. 11, 2007

Related U.S. Application Data

(63) Continuation-in-part of application No. 10/949,648, filed on Sep. 24, 2004, now Pat. No. 7,156,085.

(51) Int. Cl.
*F41B 11/12* (2006.01)

(52) U.S. Cl. ..... 124/66; 124/63; 124/67; 42/54; 102/502; 446/399; 434/16

(58) Field of Classification Search ..... 124/63–67; 42/54; 446/399–401, 405–407, 473; 434/16, 434/24; 102/502
See application file for complete search history.

(56) References Cited

U.S. PATENT DOCUMENTS

| | | | | |
|---|---|---|---|---|
| 3,895,459 | A * | 7/1975 | Morrison et al. | 446/430 |
| 5,186,156 | A * | 2/1993 | Clayton | 124/59 |
| 5,284,274 | A * | 2/1994 | Lee et al. | 222/79 |
| 5,381,928 | A * | 1/1995 | Lee et al. | 222/79 |
| 5,660,159 | A * | 8/1997 | Clayton | 124/66 |
| 5,913,304 | A * | 6/1999 | Johnson | 124/59 |
| 7,156,085 | B2 * | 1/2007 | Lewis et al. | 124/66 |
| 2006/0064911 | A1 * | 3/2006 | Lewis et al. | 42/54 |

* cited by examiner

*Primary Examiner*—Bret Hayes
*Assistant Examiner*—Michael D David
(74) *Attorney, Agent, or Firm*—Alix, Yale & Ristas, LLP

(57) ABSTRACT

A toy gun includes a firing mechanism activated to cause rapid movement of a pneumatic piston to cause rapid ingress of air into a cartridge to cause firing of a soft projectile. A release mechanism causes ejection of spent cartridges from the gun after firing.

6 Claims, 13 Drawing Sheets

TOY GUN

CROSS-REFERENCE TO RELATED APPLICATION

This is a Continuation-in-Part of U.S. patent application Ser. No. 10/949,648 filed on Sep. 24, 2004, now U.S. Pat. No. 7,156,085 the entire disclosure of which is incorporated herein by cross-reference.

BACKGROUND OF THE INVENTION

The present invention relates to toy guns. More particularly, although not exclusively, the invention relates to toy guns which can fire soft projectiles pneumatically.

Toy guns that can fire a projectile are known. These usually comprise a mechanism that fires a projectile directly from a gun barrel or magazine.

OBJECT

It is an object to provide toy guns that can fire soft projectiles pneumatically from reusable cartridges. It is a further object to provide toy guns having means of ejecting spent cartridges once a soft projectile is fired therefrom.

DISCLOSURE

There is disclosed herein a toy gun, comprising:

a body, a barrel rotatably mounted to the body and comprising a plurality of cartridge-receiving chambers located radially about a pivot and each adapted to receive individual soft projectile-loaded cartridges, a pneumatic piston located within the body and communicating with each cartridge-receiving chamber, a firing mechanism, activation of which enables rapid movement of the pneumatic piston to cause rapid ingress of air into one of the cartridges to cause firing of the soft projectile therefrom, and a release mechanism, activation of which causes ejection of spent cartridges from the barrel.

Preferably, the toy gun comprises a priming lever attached to the gun body by a spring, the priming lever being attached to the piston.

Preferably, the release mechanism comprises a pusher to push the spent cartridges longitudinally from the barrel.

Preferably, the toy gun further comprises a door, opening of which reveals a said cartridge-receiving chamber.

Preferably, the pusher comprises a cam, and the toy gun further comprises a pushbutton having a ramp surface that bears against the cam upon depression thereof.

Preferably, the toy gun further comprises a trigger, and wherein the piston has a tooth thereon, and wherein the firing mechanism comprises a carriage having a pawl engageable with the tooth, the carriage moving linearly upon the activation of trigger to release the pawl from the tooth.

There is further disclosed herein a toy gun, comprising:

a body, a firing chamber within the body, a magazine mounted to the body and housing an array of soft projectile-loaded cartridges, a loading mechanism for successively presenting individual cartridges to the firing chamber, a pneumatic piston located within the body and communicating with the firing chamber, a firing mechanism, activation of which enables rapid movement of the pneumatic piston to cause rapid ingress of air into a cartridge located in the firing chamber to cause the soft projectile to deploy from the cartridge, and a release mechanism bearing against a cartridge in the firing chamber, activation of which causes ejection of spent cartridge therefrom.

Preferably, the toy gun further comprises a pneumatic line between the cylinder and the firing chamber.

Preferably, the loading mechanism comprises a push rod and a priming lever, wherein pivotal movement of the priming lever causes longitudinal movement of the push rod to provide a loading area into which a cartridge is received.

Preferably, the cartridge comprises a spring bearing against one cartridge in the array of cartridges, biasing the same toward the loading area.

Preferably, the toy gun further comprises a drawbar acting on the pneumatic piston upon movement of the priming lever.

Preferably, the release mechanism comprises a locking tab engageable by the drawbar.

Preferably, the toy gun further comprises a trigger, and wherein the piston has a tooth thereon, and wherein the firing mechanism comprises a pivot arm having a pawl engageable with the tooth, the pivot arm moving pivotally upon the activation of trigger to release the pawl from the tooth.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
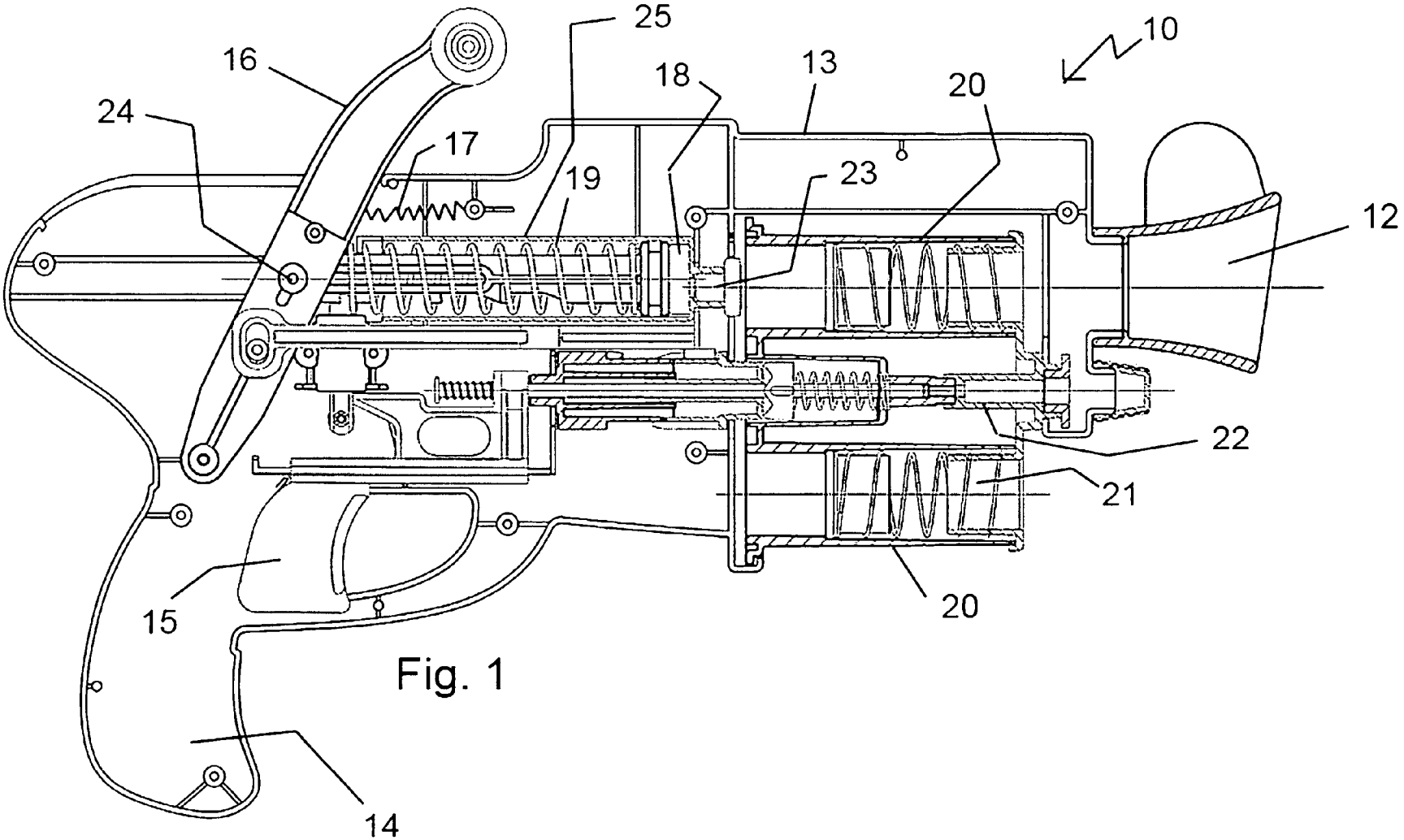
FIG. 1 is a schematic cross-sectional elevation of a first toy gun in an unloaded state.

In FIGS. 1 to 4 of the accompanying drawings there is depicted schematically a first toy gun embodiment taking the form of a pistol 10. Most of the parts of the pistol are made of moulded plastics material, however springs and pivot pins for example would typically be metallic.

The pistol 10 comprises a muzzle 12, and body 13 and a handle 14. The pistol comprises a trigger 15 and a priming lever 16. The priming lever 16 is mounted pivotally at its bottom end to the handle 14.

A light tension return spring 17 is connected at its forward end to a mounting point within the pistol body, and at its rearward end to the priming lever 16.

Located within the pistol body 13 is a cylinder 25 within which a longitudinally moving piston 18 can slide. A strong firing spring 19 biases the piston 18 forward. The piston is connected at its tail end to the priming lever 16 by pivot pin 24. When the priming lever 16 is drawn backward against return spring 17, the firing spring 19 is energised in compression, ready for release upon depression of trigger 15.

Figure 5:
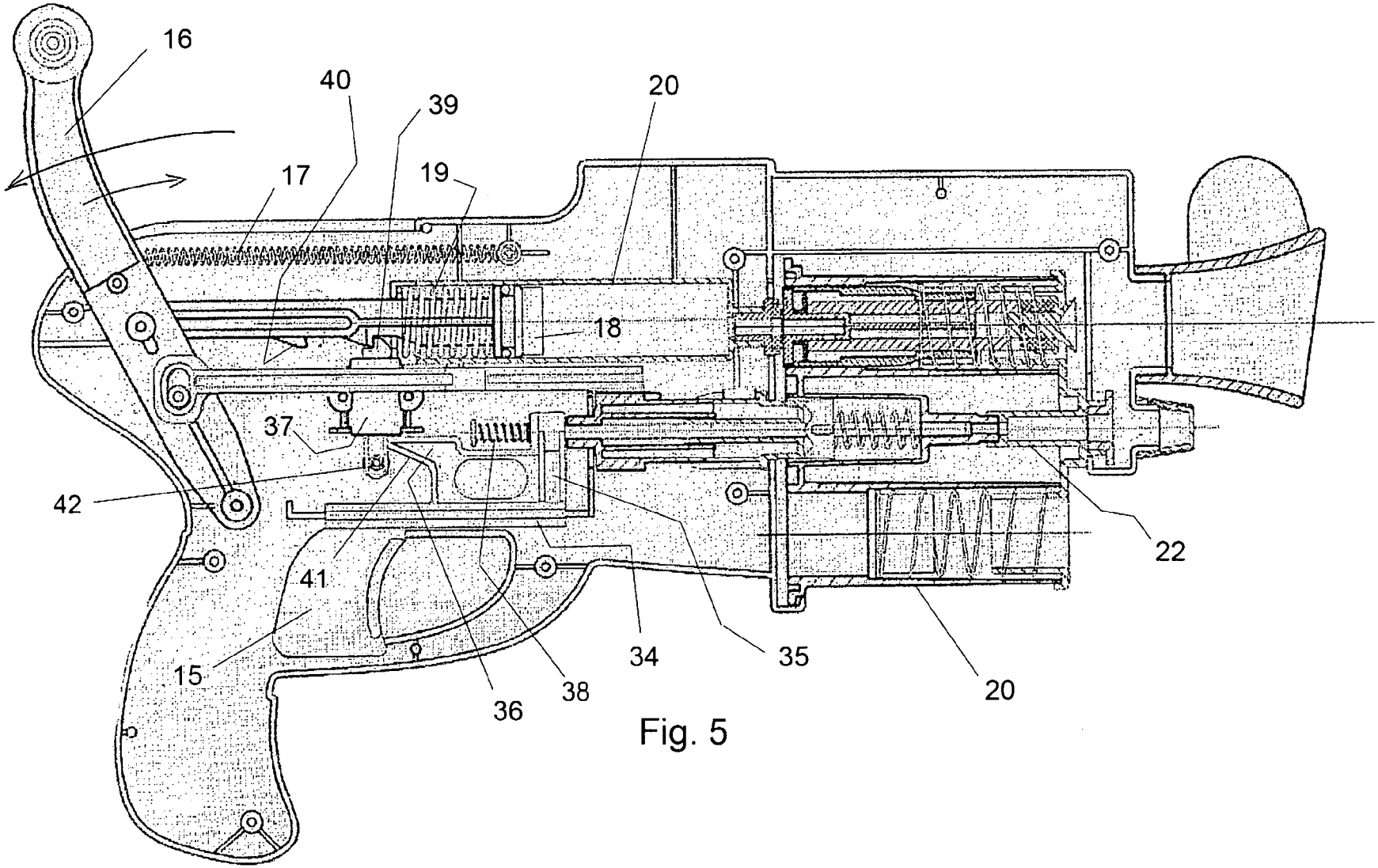
FIG. 5 is a schematic cross-sectional elevation of the first toy gun showing details of the firing mechanism prior to firing.
Figure 6:
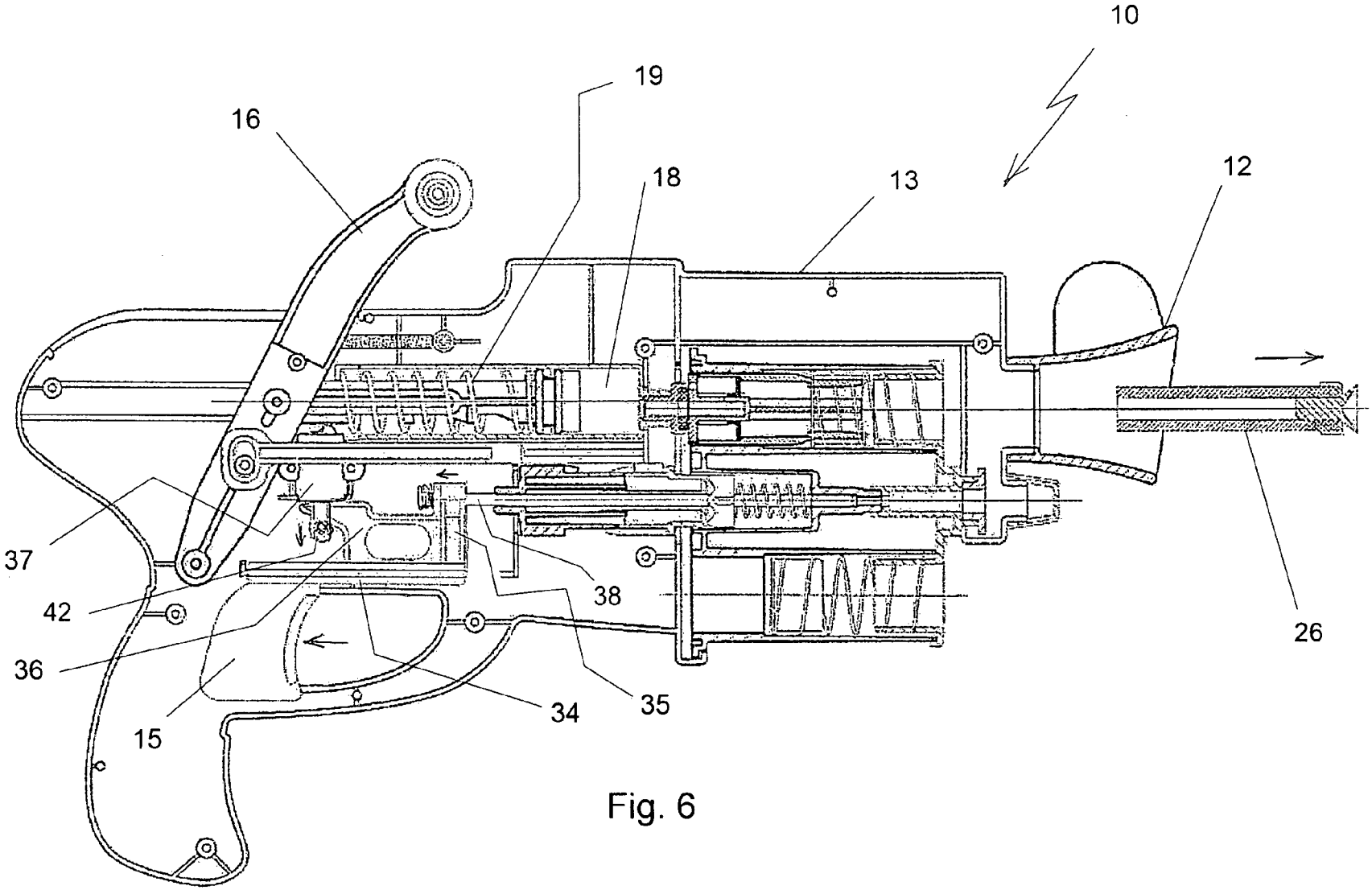
FIG. 6 is a schematic cross-sectional elevation of the first toy gun showing the firing mechanism released and fired.
Figure 7:
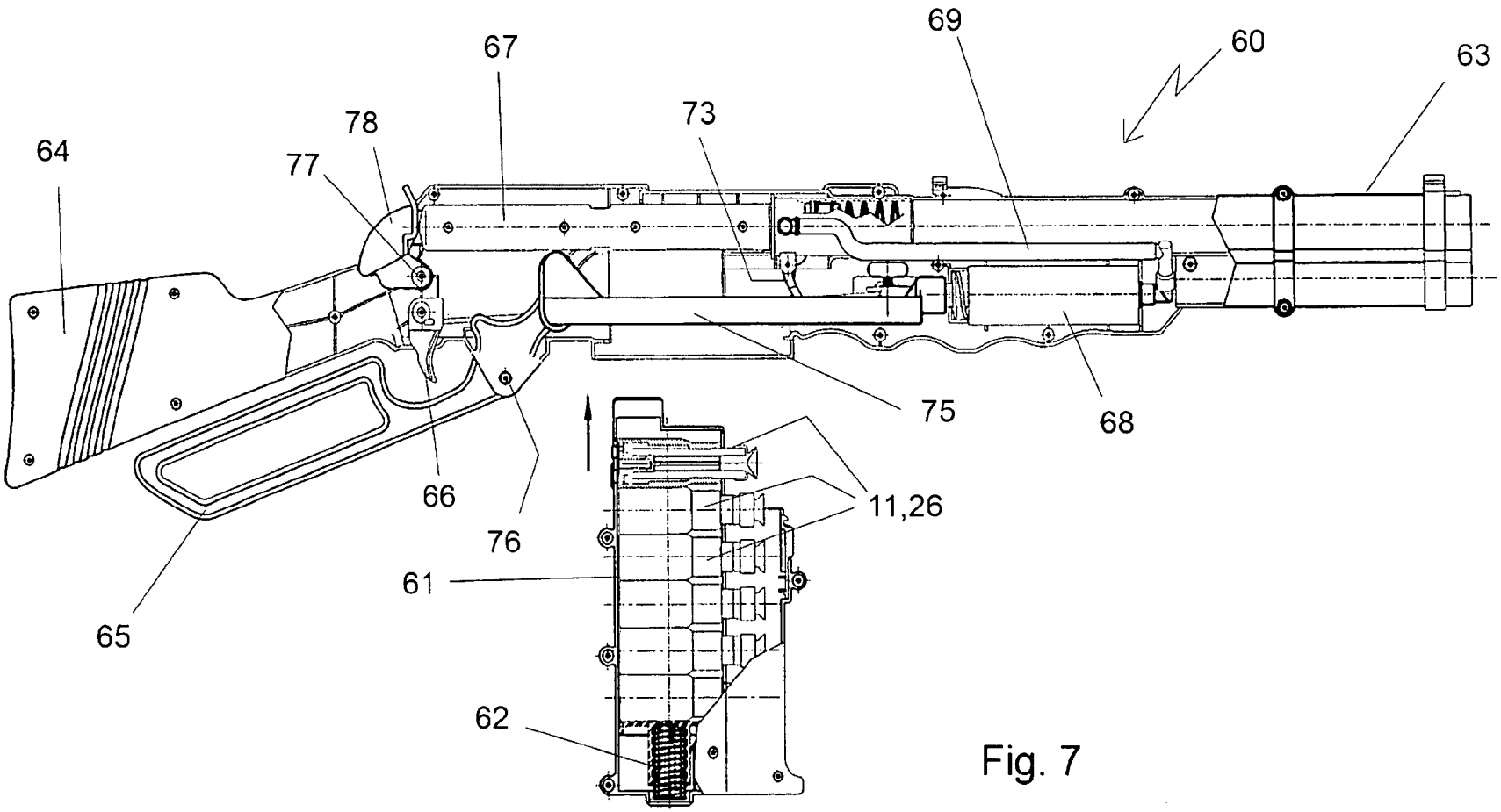
FIG. 7 is a schematic cross-sectional elevation of a second toy gun and a detached magazine.

As shown in FIGS. 5 and 6, the firing mechanism comprises a trigger drawbar 34 to which the trigger 15 is attached. At the forward end of the drawbar 34, there is an upward-extending rider 35 which slides along a longitudinal guide pin 37. Formed integrally with the rider 35 and drawbar 34 is a pusher 36 having a ramp surface 41 at its tail end. A carriage 37 mounted within the body of the toy gun has a pawl 39 engageable with a series of teeth 40 of the piston 18. When the pawl 39 engages one of the teeth 40, the piston 18 cannot move forward. Whichever one of teeth 40 is engaged by the pawl 39 depends on how far back the priming lever is pulled back use. This provides user-selection of soft or hard firing of a projectile. A wheel 42 depends from the carriage 37. The carriage is adapted to move vertically within the body of the toy gun. When the ramp surface 41 bears against the wheel 42 upon depression of the trigger 15, the pawl 39 will release from tooth 40 so that the energy of compressed spring 19 is released to cause the piston 18 to rush forward.

Also within the body 13, there is a barrel 20 rotatably mounted upon a pivot post 22. The barrel 20 comprises a number of longitudinally extending cartridge-receiving chambers 21 located radially about the pivot post 22. The barrel 20 can be manually rotated about the post 22 to bring each one of the cartridge chambers into alignment with the piston 18.

At the forward end of the cylinder 25 there is an air injector port 23. This communicates with the back of an aligned cartridge chamber 20.

Figure 2A:
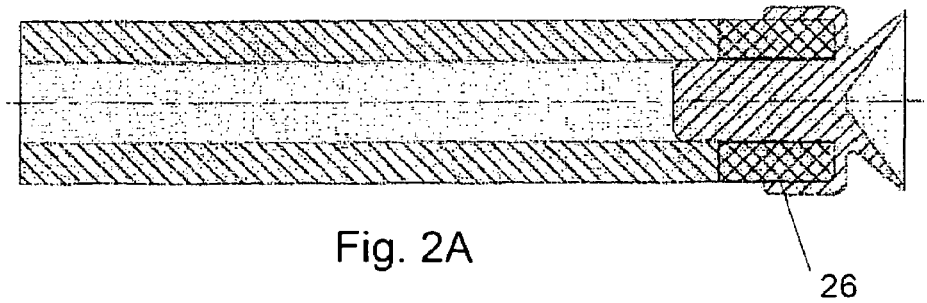
FIG. 2A somatic cross-sectional elevation of a reusable projectile.
Figure 2B:
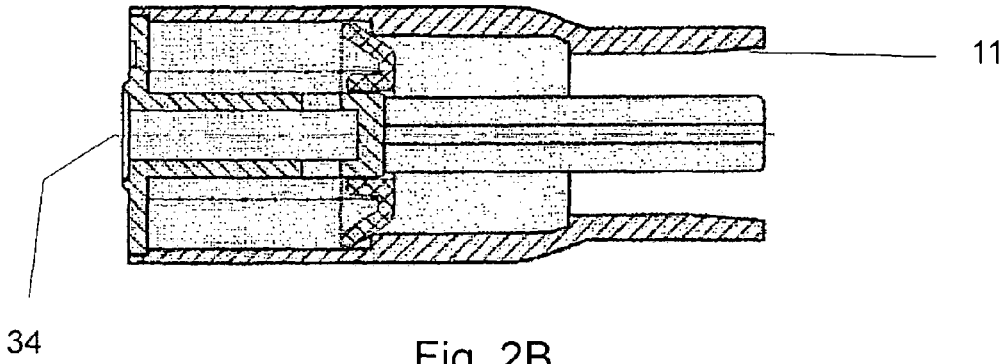
FIG. 2B is a schematic cross-sectional elevation of a reusable cartridge.
Figure 2C:
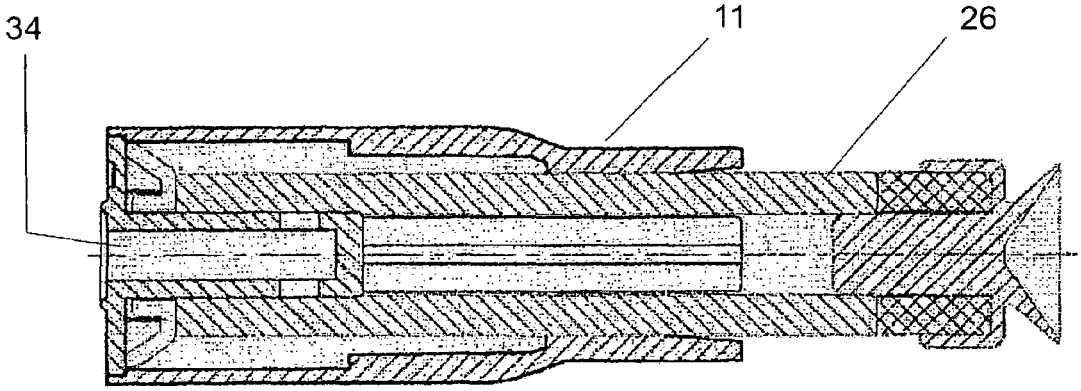
FIG. 2C is a schematic cross-sectional elevation of the reusable projectile and cartridge together.
Figure 3:
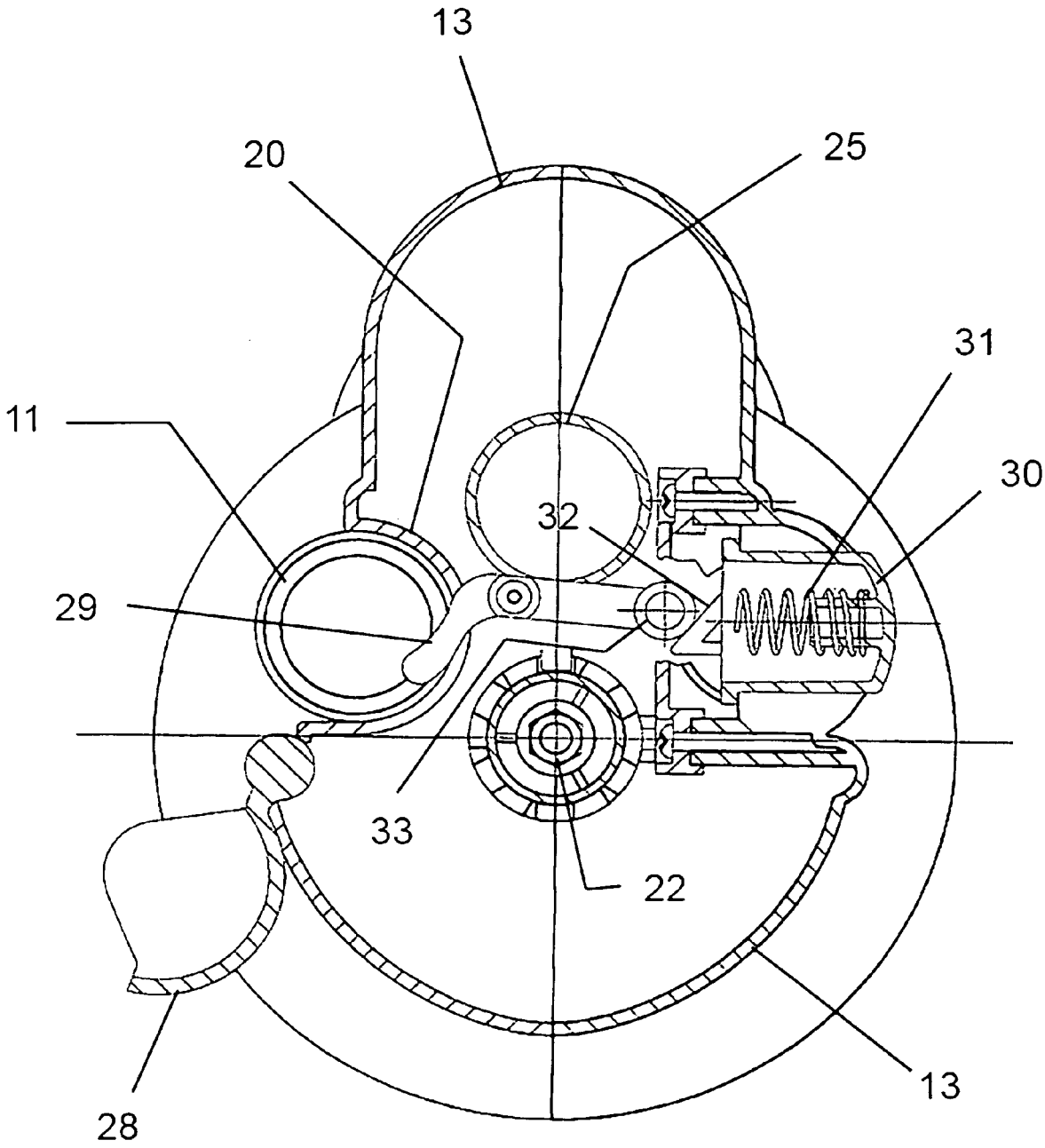
FIG. 3 is a schematic cross-sectional front elevation of the barrel portion of the toy guns of FIG. 1.
Figure 4:
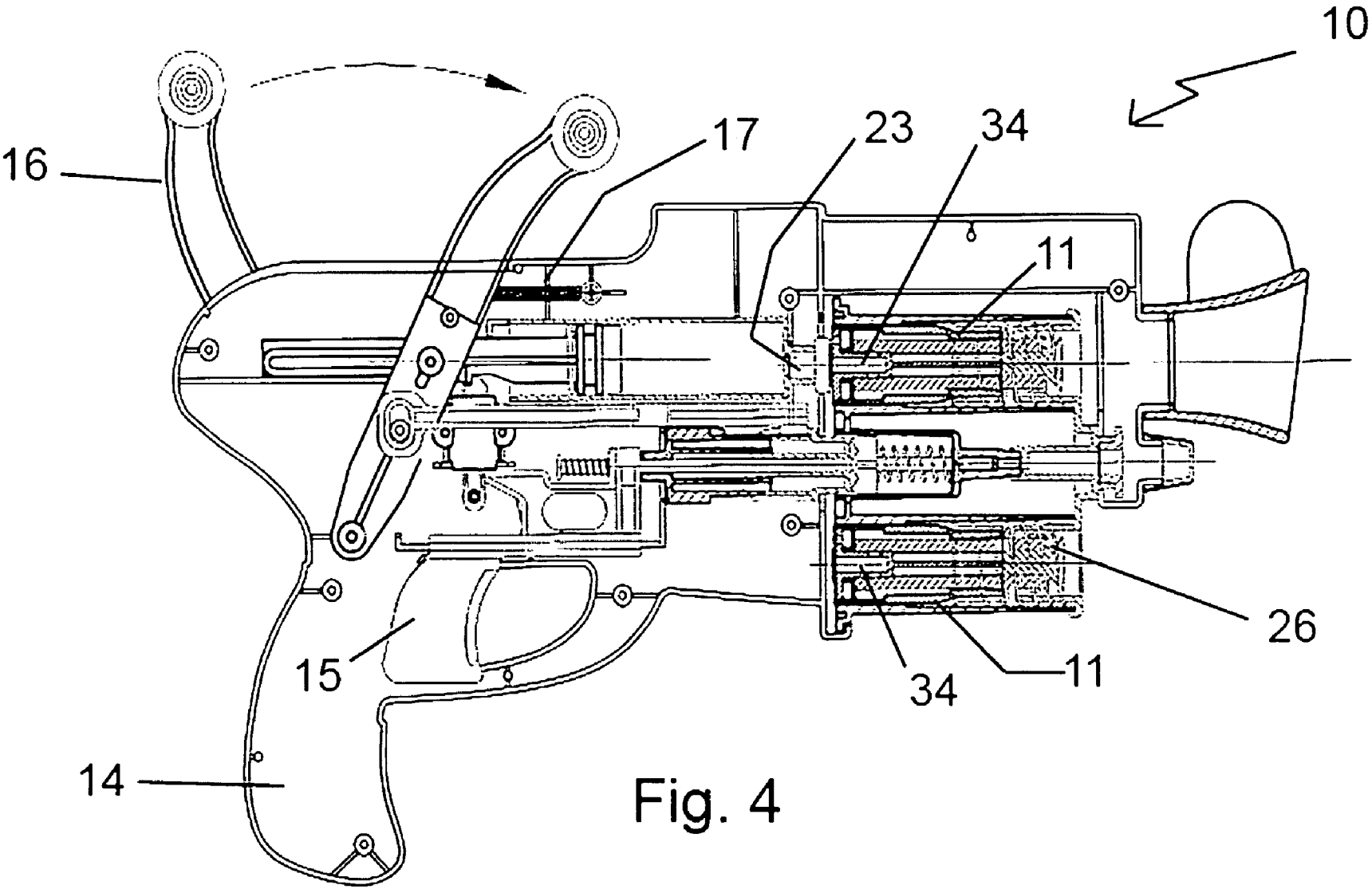
FIG. 4 is a schematic is a schematic cross-sectional elevation of the first toy gun in a loaded state.

The cartridge 11 and soft projectile 26 are shown in FIGS. 2A. 2B and 2C and shall not be described in detail as these components are described in U.S. patent application Ser. No. 10/949,648 cross referenced above. Suffice to say that the soft projectile 26 is received upon an internal air injection post 34 of the cartridge 11 and that each cartridge/projectile is to be received by one of the chambers 21 of the barrel 20. To this end, and as illustrated in the FIG. 3, the body 13 comprises a hinged door 28 which can be opened to enable insertion and ejection of cartridges 11. In order to facilitate ejection of the spent cartridges, a cartridge release button 30 is provided. Spring 31 biases the release button 30 into a raised position. At the back of a button 30, there is provided a ramp 32 that bears against a cam 33 of a pusher 29. Upon depression of the pushbutton 30, the ramp will move to the left and bear upon the cam 33 to cause movement of the pusher 29 to the left. The door 28 will have been opened manually, so that depression of the pushbutton 30 will push a cartridge past it.

When located within that chambers which is aligned with the piston 18, the cartridge 11 seals against the air injection port 23.

When the trigger 15 is depressed, the above-described firing mechanism will release so that the energy stored within firing spring 19 causes the piston 18 to move rapidly forward so that air passing through the injector port 23 rapidly pressurises the cartridge to cause the soft projectile to rapidly deploy through the muzzle 12. The projectiles can be manually reloaded by insertion through a forward opening of each cartridge chamber into a cartridge located therein, or alternatively, the cartridges can be ejected by depression of the release button 30 for external reloading and reinsertion into the cartridge chambers upon manual rotation of the barrel.

A second toy gun is depicted in FIGS. 7 to 14. This embodiment takes the form of a rapid-fire rifle 60 with parts predominantly made of plastics, but again with critical wear parts made of metal.

Figure 8:
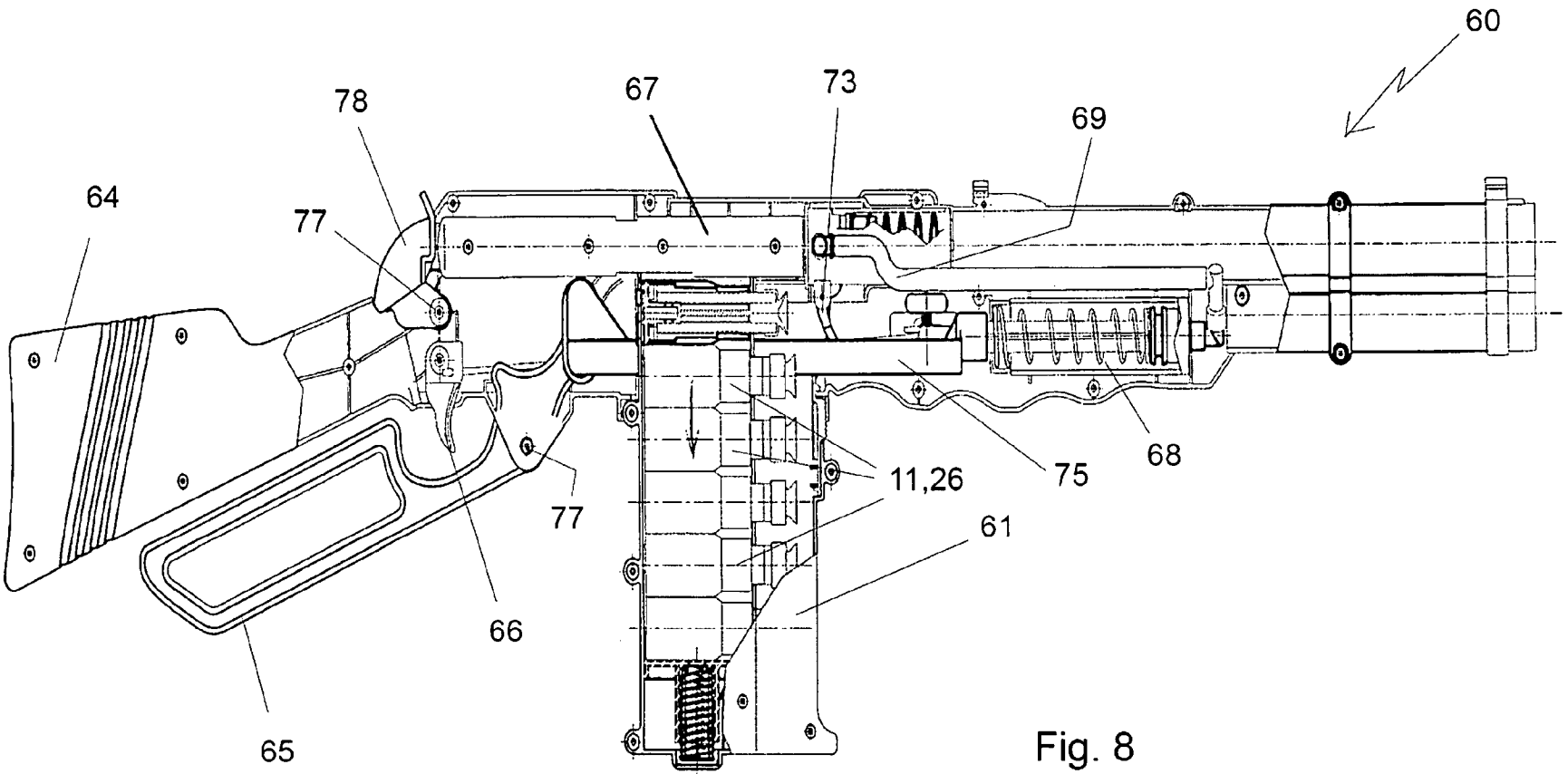
FIG. 8 is a schematic cross-sectional elevation of the toy gun of FIG. 7 with the magazine attached thereto.

The toy rifle 60 comprises a muzzle 63 and a stock 64 formed as an integral structure. A separate magazine 61 contains an array of cartridges 11 each having a soft projectile 26 therein. The array of cartridges is biased upwardly by a spring 62 at the base of the magazine 61. The magazine is attachable to the toy rifle as shown in FIG. 8.

The rifle also comprises a priming lever 65 mounted pivotally at 76 to the rifle body.

Figure 10:
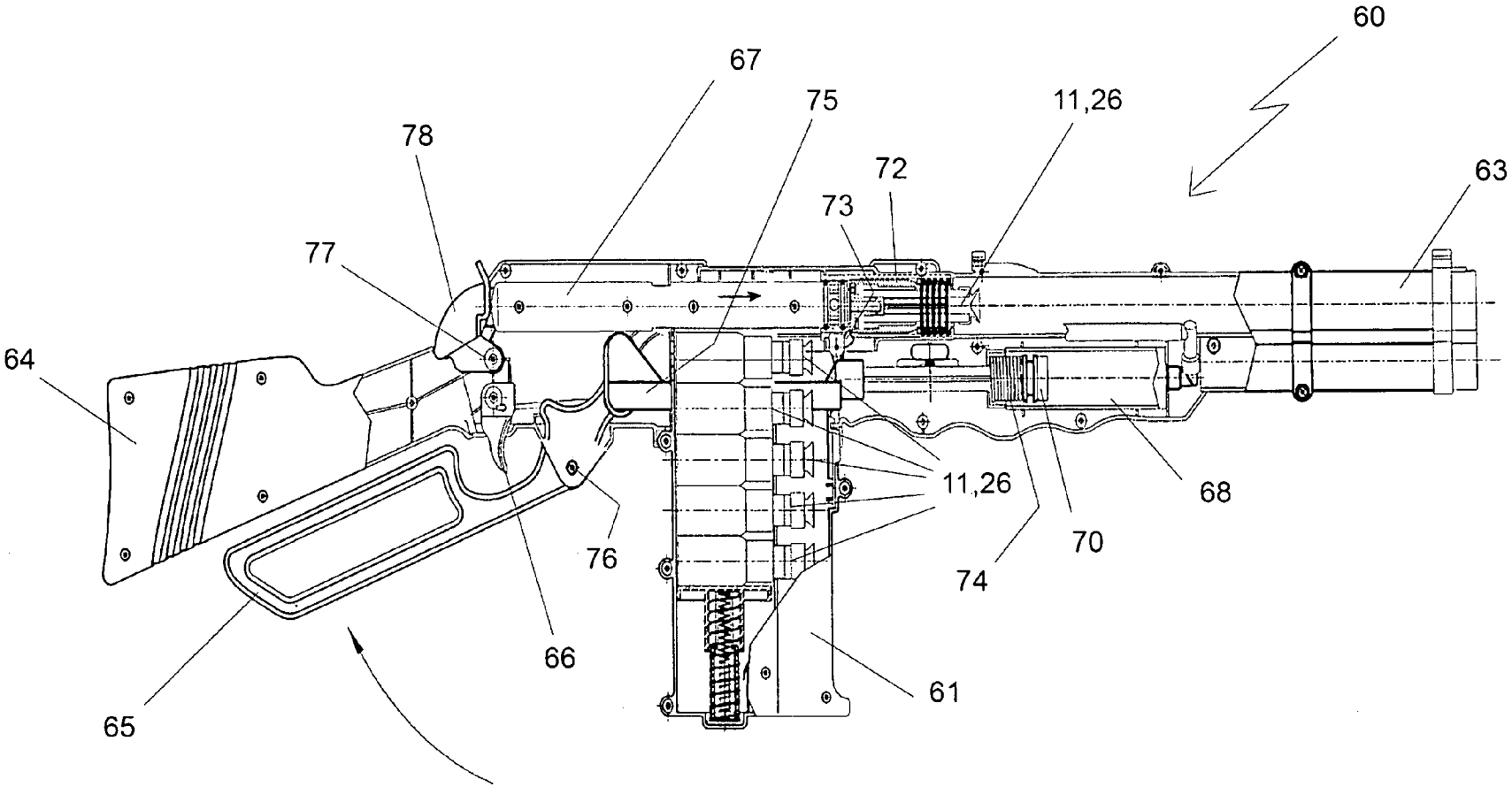
FIG. 10 is a schematic cross-sectional elevation of the toy gun of FIGS. 7 to 9 in a primed and ready-to-fire state.

A pneumatic cylinder 68 is located in the bottom part of the muzzle 63 and has extending from it a pneumatic line 69. The pneumatic line 69 extends into a firing chamber 72 (FIG. 10). Slidably mounted within the cylinder 68 is a piston 70. The piston 70 is acted upon by a drawbar 75. Movement of the drawbar 75 is affected by pivotal movement of priming lever 65. As can be seen in the drawings, the priming lever 65 is mounted pivotally at 76. Its proximal end engages with the drawbar 75 to cause it to move longitudinally within the body of the rifle 60.

Located in the upper part of the body of the rifle 60 is a push rod 67. The rear end of the push rod 67 is covered by a door 78 that is mounted pivotally at 77 to the body of the rifle. Upon attachment of the magazine 61 to the rifle body, the uppermost cartridge 11 presses against the underside of the push rod 67 as shown in FIG. 8. This in effect pushes down on the array of cartridges against the action of the spring 62.

Figure 9:
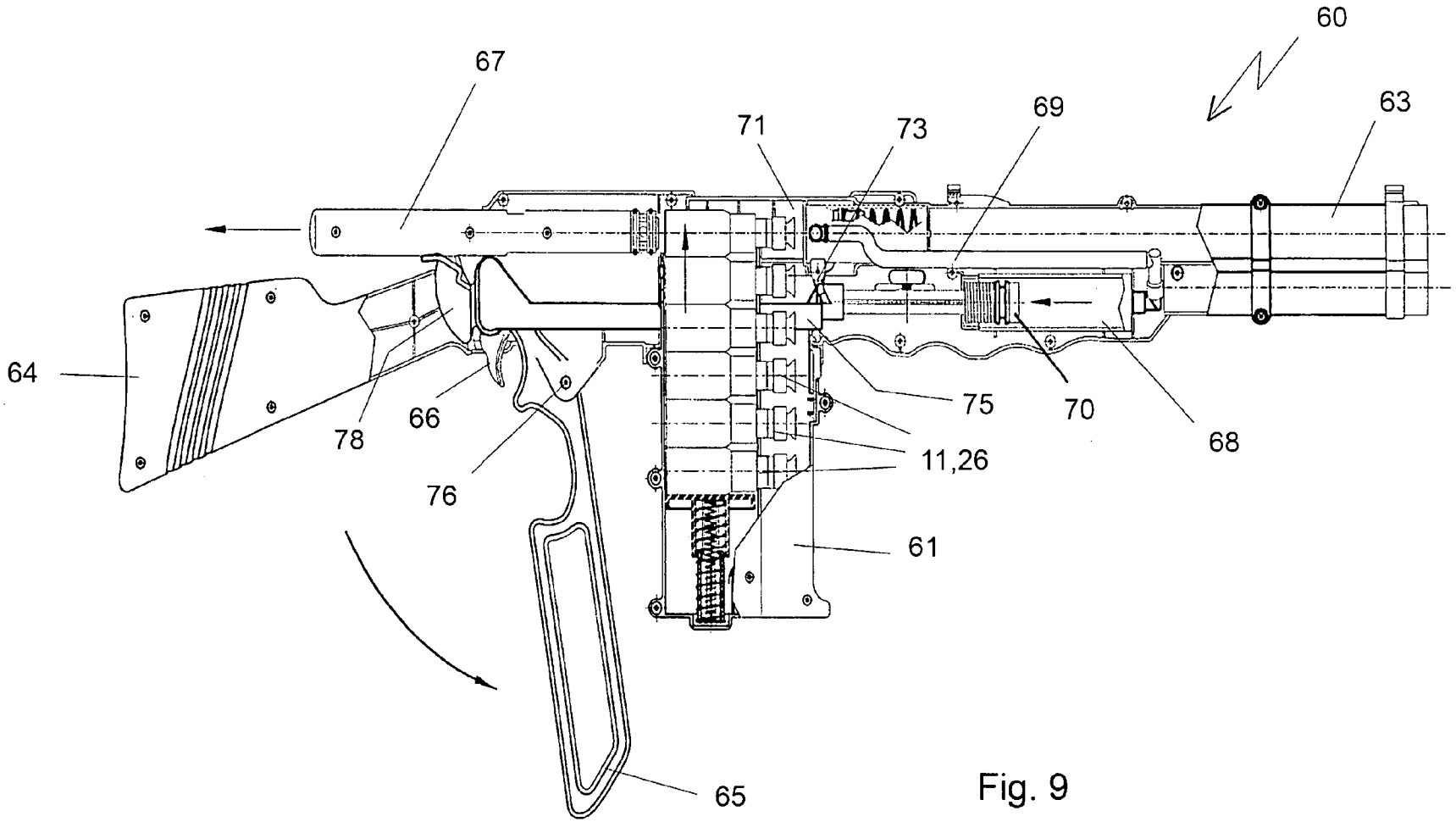
FIG. 9 is a schematic cross-sectional elevation of the toy gun of FIGS. 7 and 8 with its priming lever extended into a priming position.

When the priming lever 65 is pivoted downwardly into the position depicted in FIG. 9, the drawbar 75 and push rod 67 both move backward as indicated. The back end of the push rod 67 opens the door 78 as it becomes exposed. The forward end of the push rod 67 clears the array of cartridges so that the uppermost cartridge moves upward into a loading area 71. As a result of backward movement of the drawbar 75, the piston 70 pulls back on the spring 74 to thereby store potential energy therein.

Figure 11:
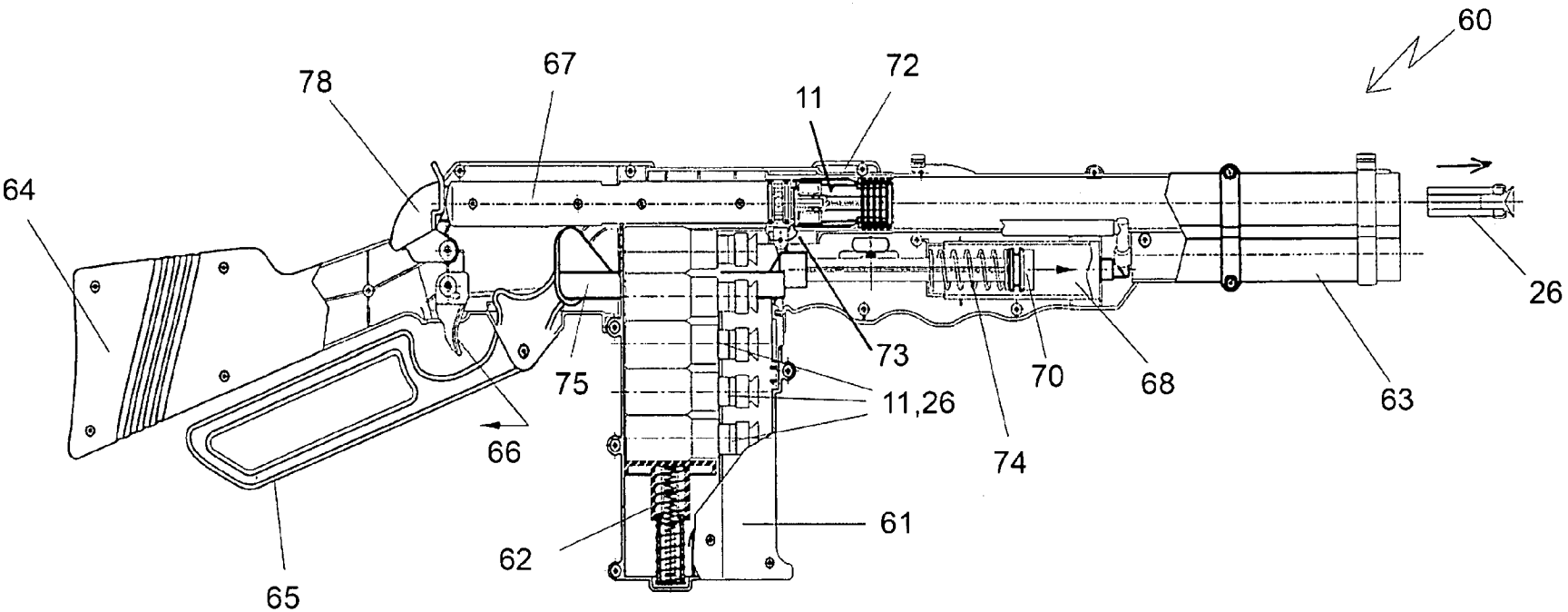
FIG. 11 is a schematic cross-sectional elevation of the toy gun in a firing state.

The priming lever 65 is then pivoted back to the position depicted in FIG. 10, during which movement the push rod 67 moves forward to thereby push the cartridge 11 and projectile 26 into a firing chamber 72 ready for firing. During this forward movement, the drawbar 75 returns to its initial position, but the piston 70 remains in its drawn-back position due to its interaction with a locking mechanism 73. The locking mechanism holds the cartridge 11 in the firing chamber 72, and also holds the piston 70 against the spring 74 until trigger 66 is activated. Once the trigger 66 is activated and as shown in FIG. 11, the piston 70 moves rapidly forward under the action of spring 74 to present a rapid stream of air through the pneumatic line 69. This air is presented into the firing chamber behind the cartridge 11 so that air passes rapidly through its air injection post to deploy the projectile 26 as illustrated.

The firing mechanism of the rifle is similar to that of the first embodiment, however rather than providing a sliding carriage 37, a pivot elbow 81 is provided with a pawl 79 which interacts with teeth 80. The trigger 66 is connected to the bottom part of the pivot elbow 81 so that when the trigger is pulled, the elbow 81 pivots in a clockwise sense so that the pawl 79 is drawn downwardly away from teeth 80.

Figure 12:
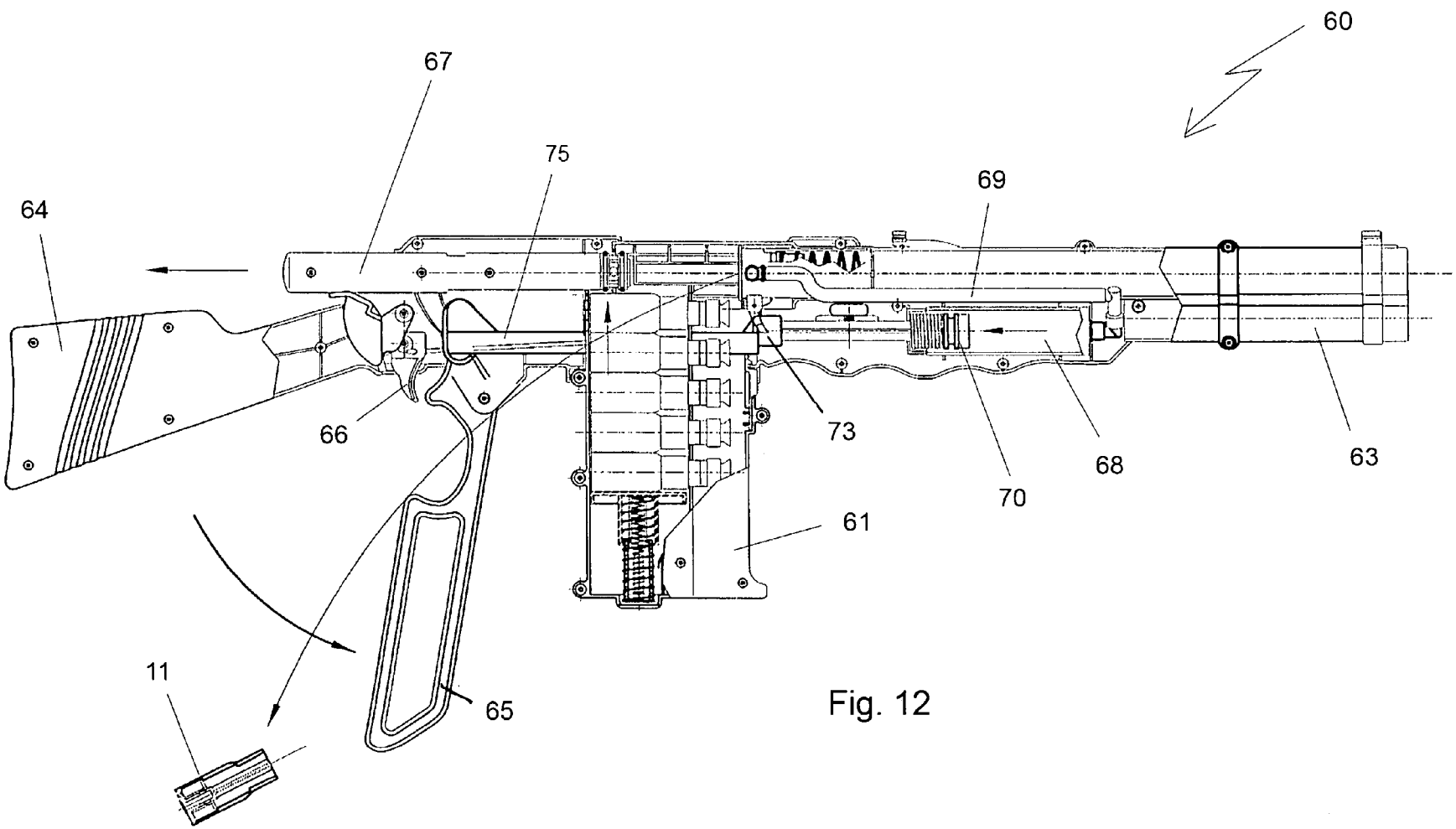
FIG. 12 is a schematic cross-sectional elevation of the toy gun in a post-firing cartridge-release configuration.
Figures 13, 14, 15:
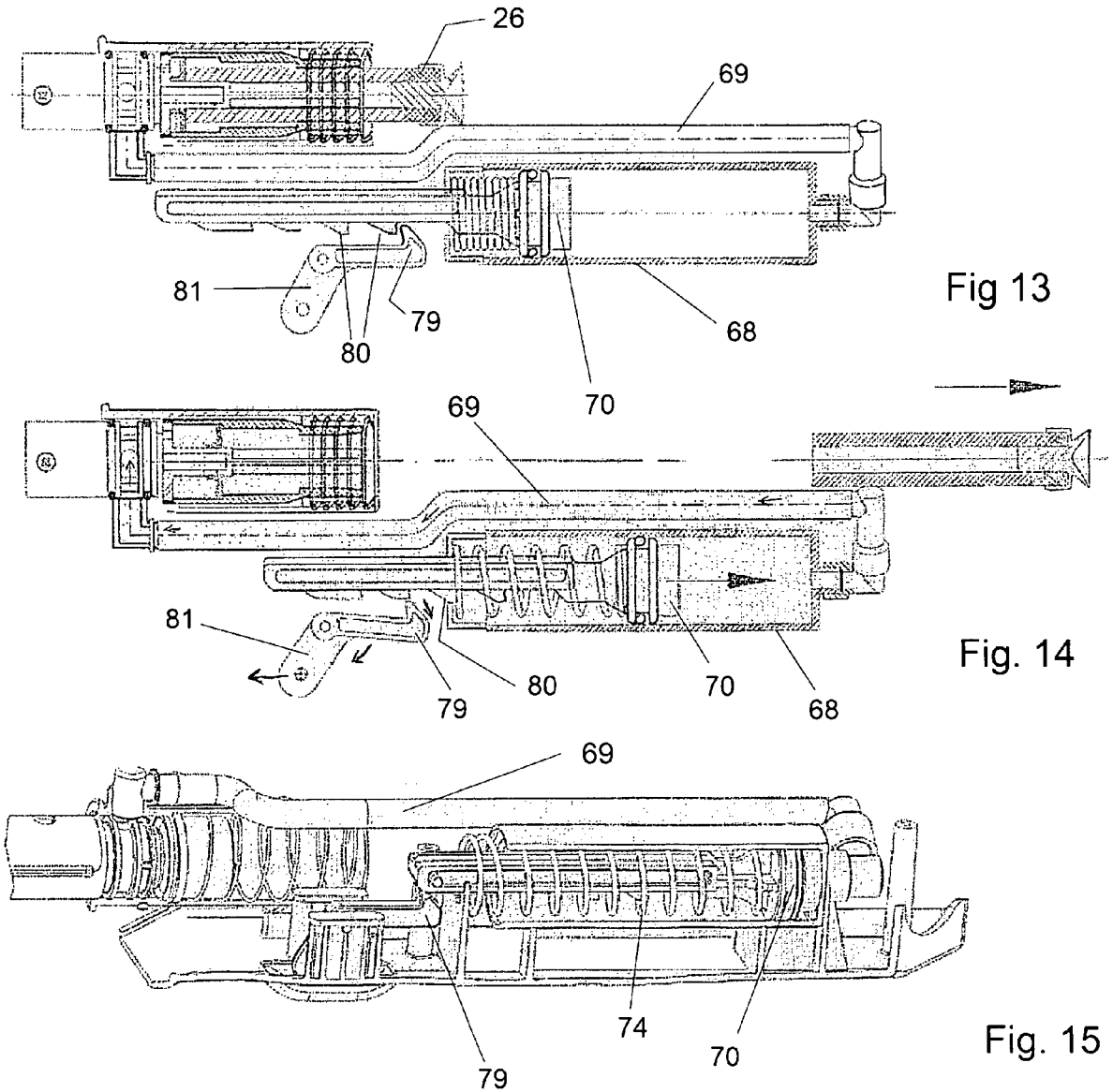
FIGS. 13, 14 and 15 are schematic cross-sectional elevations of the firing mechanism of the toy guns of FIGS. 7 to 12.

After firing, and as shown in FIG. 12, the priming lever 65 is manually returned to its downward extended position whereupon the cartridge lock 73 releases the cartridge 11 for ejection as shown. To facilitate ejection of the spent cartridge, a light coil spring is provided in the firing chamber as depicted. This light spring is compressed as the push rod pushes a cartridge into the firing chamber. As the priming lever 65 is moved down, the piston 70 is again primed ready for triggering. The cycle continues until all cartridges of the magazine are spent and ejected in succession.

It should be appreciated that modifications and alterations obvious to those skilled in the out are not to be considered as beyond the scope of the present invention. For example, rather than providing a pneumatic line between the cylinder 68 and firing chamber, the cylinder 68 might be presented directly behind the firing chamber or might even be incorporated into the push rod.

The invention claimed is:

1. A toy gun, comprising:

a body, a firing chamber within the body, a magazine mounted to the body and housing an array of soft projectile-loaded cartridges, a loading mechanism for successively presenting individual cartridges to the firing chamber, said loading mechanism comprising a push rod and a priming lever, wherein pivotal movement of the priming lever causes longitudinal movement of the push rod to provide a loading area into which a cartridge is received, a pneumatic piston located within the body and communicating with the firing chamber, a firing mechanism, activation of which enables rapid movement of the pneumatic piston to cause rapid ingress of air into a cartridge located in the firing chamber to cause the soft projectile to deploy from the cartridge, and a release mechanism bearing against a cartridge in the firing chamber, activation of which causes ejection of a spent cartridge therefrom.

2. The toy gun of claim 1, further comprising a pneumatic line between a cylinder and the firing chamber.

3. The toy gun of claim 1, wherein the cartridge comprises a spring bearing against one cartridge in the array of cartridges, biasing the same toward the loading area.

4. The toy gun of claim 3, further comprising a drawbar acting on the pneumatic piston upon movement of the priming lever.

5. The toy gun of claim 4, wherein the release mechanism comprises a locking tab engageable by the drawbar.

6. The toy gun of claim 1, further comprising a trigger, and wherein the piston has a tooth thereon, and wherein the firing mechanism comprises a pivot arm having a pawl engageable with the tooth, the pivot arm moving pivotally upon the activation of trigger to release the pawl from the tooth.

* * * * *